United States Patent [19]

Pan Lei

[11] 4,016,849

[45] Apr. 12, 1977

[54] APPARATUS FOR INCREASING THE IGNITION VOLTAGE OF INTERNAL COMBUSTION ENGINES

[75] Inventor: Peter Pan Lei, Taipei, Taiwan, China /Taiwan

[73] Assignee: Gerd Krommes, Wuppertal, Germany

[22] Filed: June 23, 1975

[21] Appl. No.: 589,414

[30] Foreign Application Priority Data

June 25, 1974 Germany ..... 2430389
July 22, 1974 Germany ..... 2435159

[52] U.S. Cl. ..... 123/148 DC; 315/209 CD; 315/209 M; 123/148 E

[51] Int. Cl.[2] ..... F02P 1/00; H05B 37/02

[58] Field of Search .... 123/148 DC, 148 R, 148 E, 123/148 TCD, 148 BCD; 315/209 CD, 209 M, 209 R

[56] References Cited

UNITED STATES PATENTS

| | | | |
|---|---|---|---|
| 2,905,831 | 9/1959 | Scott | 123/148 DC |
| 2,980,093 | 4/1961 | Short | 123/148 BCD |
| 3,220,396 | 11/1965 | Heidner et al. | 123/148 E |
| 3,260,891 | 7/1966 | Judson | 123/148 E |
| 3,645,246 | 2/1972 | Campell et al. | 123/148 E |
| 3,673,998 | 7/1972 | Phillips | 123/148 E |
| 3,753,428 | 8/1973 | Phillips | 123/148 E |
| 3,901,205 | 8/1975 | Brongsberg | 123/148 E |

*Primary Examiner*—Charles J. Myhre
*Assistant Examiner*—Paul Devinsky
*Attorney, Agent, or Firm*—W. G. Fasse; W. W. Roberts

[57] ABSTRACT

The present circuit arrangement for generating a high voltage for the spark plugs of an internal combustion engine, includes an ignition coil having a secondary winding coupled to the spark plugs. One end of the primary winding of the coil is connected to one terminal of a battery by a conventional contact breaker. A capacitor and first switch are connected in that order between the other end of the primary winding and the other terminal of the battery. A diode is connected in parallel with the capacitor and first switch. A second switch is connected between the first terminal of the battery and the junction of the capacitor and the second switch. The first switch opens and closes in synchronism with the contact breaker. The second switch is open when the contact breaker is closed, and vice versa. The circuit functions as a voltage doubler whereby the voltage applied to the primary winding is doubled as compared to the battery voltage.

11 Claims, 8 Drawing Figures

APPARATUS FOR INCREASING THE IGNITION VOLTAGE OF INTERNAL COMBUSTION ENGINES

BACKGROUND OF THE INVENTION:

This invention relates to ignition systems for internal combustion engines, and more in particular to an apparatus for increasing the ignition voltage of internal combustion engines in motor vehicles.

It is known that combustion in the operation of motor vehicle internal combustion engines has hitherto only been incomplete, and hence that some of the fuel (generally 15 to 25%) is discharged unburnt together with the exhaust gases. One of the main reasons for this problem is the imperfection of the ignition systems currently in use.

In order to ignite a mixture of fuel and air, the ignition spark must have a given minimum energy, i.e. ignition energy. If the energy is less than this ignition energy then, although, a spark may occur, there will be no ignition of the gases. When they are in perfect condition, normal coil ignition systems produce adequate secondary voltage on the secondary side to ignite the gases, but the voltage induced in the secondary winding rises with increases in the primary current at the moment of opening of the contact-breaker contact. Since the primary current does not increase abruptly on closing of the contact, but rises with some delay to a steady current determined by the battery voltage and the ohmic resistance of the circuit, the maximum secondary voltage corresponding to the steady current is therefore attained only at low engine speeds or low spark frequencies. The time the contacts are closed decreases as the engine speed increases, so that there is reduced energy storage in the magnetic field of the ignition coil and hence a reduced secondary voltage at higher engine speeds. Thus, as the engine speeds increase, the energy of an increasing number of sparks may be inadequate to ignite the fuel-air mixture.

Apart from too short a closing time, reduced ignition voltage may result from leakages in the ignition circuit, for example due to leaking water, dirt and oily deposits on insulated parts, and combustion residues on the insulator foot of the spark plug. The same applies to the capacitative load. For example, a capacitative load may increase to such an extent due to dirt in the ignition system, and particularly the ignition lead, that the secondary voltage alone drops to half of the value that it would otherwise have. As soon as the condition of the ignition system departs from the ideal state, and in practice this is the case after just a short period of use, times during which ignition fails to occur become increasingly more frequent, particularly at higher engine speeds, owing to inadequate energy at the spark plugs. Particular difficulties arise in this respect upon starting of a cold engine, and if the battery is not fully charged.

Various ignition systems have been developed to solve the problem of inadequate ignition voltage. In one of these known ignition systems, a device of the above described type is used in which the ignition voltage is increased by means of a capacitor. The disadvantage of this known device is that it results in greater power consumption, it has low efficiency, and the circuit is complex and expensive. In addition, the difficulties are even greater when the known device employing a capacitor operates at high voltages and with high current.

OBJECTS OF THE INVENTION

In view of the above, it is the aim of the invention to achieve the following objects, singly or in combination:

to provide an ignition system for an internal combustion engine which overcomes the above problems of the prior art arrangements;

to provide an ignition system for internal combustion engines, of the type employing a capacitor, wherein the voltage applied to the primary winding of the coil is increased, thereby overcoming the disadvantages of the above devices;

to provide a device for an ignition system of an internal combustion engine, including a capacitor, and means for interconnecting the capacitor with the primary winding end coil whereby the voltage applied to the coil is double the battery voltage, said device being simple in construction and having low power consumption; and to provide a device for increasing the ignition voltage applied to an internal combustion engine, and including means enabling continuation of operation of the engine in the event of breakdown of the device.

SUMMARY OF THE INVENTION

Briefly stated, in accordance with the invention a device including a capacitor is connected between the motor vehicle battery and its ignition coil, and is so constructed that the capacitor is connected in series with the primary winding of the ignition coil and is adapted to be charged up to battery voltage when the contact breaker contacts are open and that the voltage at the primary winding of the ignition coil is doubled with respect to the battery voltage when said contacts are closed.

According to another feature of the invention, a parallel connected diode is disposed between the battery and the primary winding of the ignition coil.

In this arrangement, the capacitor is charged up via the parallel connected diode, on the one hand, while on the other hand in the event of breakdown of the device a current can flow unobstructedly from the battery through the primary winding of the ignition coil.

Preferably, the device according to the invention is so constructed that a switch closed when the contact-breaker contacts are closed, is connected in series with the capacitor. The series circuit comprising the switch and capacitor is bridged by a diode which conducts in the direction of the flow of current from the battery. The connecting point between the capacitor and switch is grounded via another switch which is closed when the contact-breaker contacts are open. By the corresponding actuation of the two switches, the capacitor is charged from the battery when the contact-breaker contacts are open and is connected in series with the battery to boost the battery voltage when the contact-breaker contacts are closed.

BRIEF FIGURE DESCRIPTION

In order that the invention may be more clearly understood, it will now be disclosed in greater detail with reference to the accompanying drawings, wherein.

DETAILED DESCRIPTION OF EXAMPLE EMBODIMENTS

Figure 2:
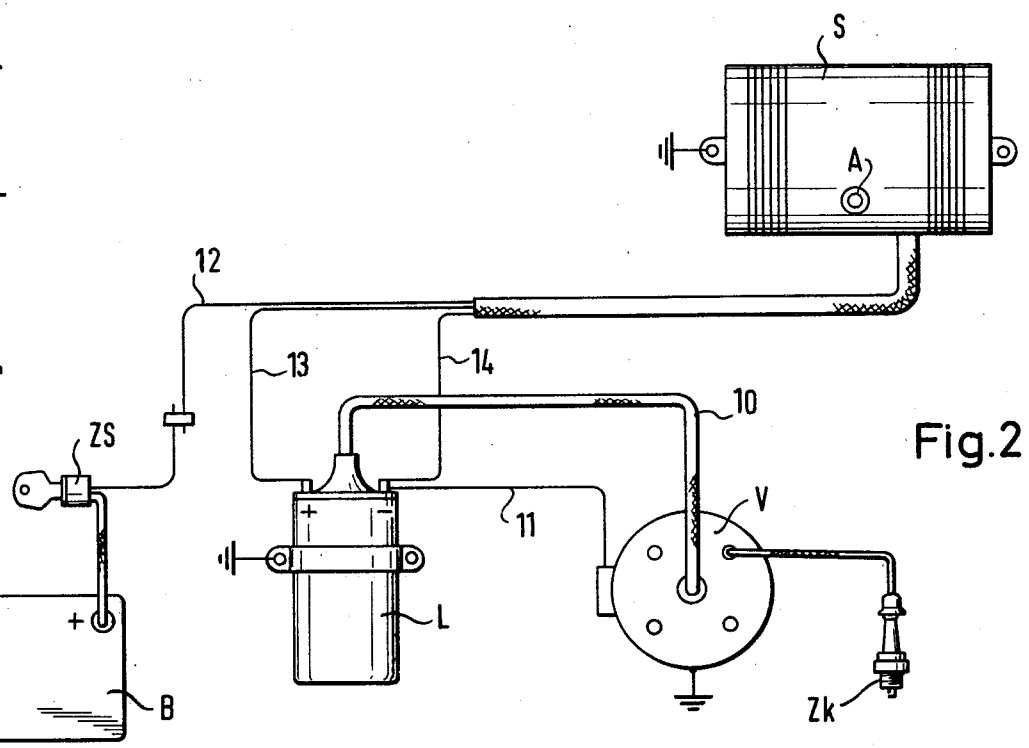
FIG. 2 is a simplified circuit diagram showing the typical installation of a device according to the invention in a motor vehicle.
Figure 1:
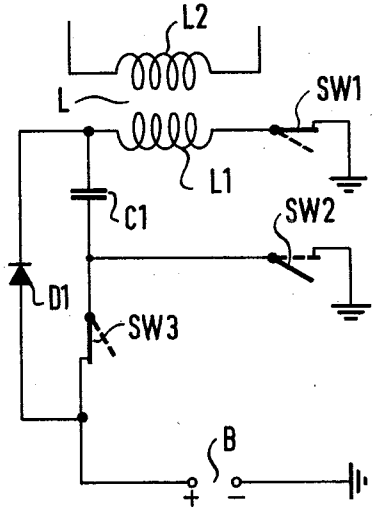
FIG. 1 is a basic circuit diagram of a device according to the invention.

Referring now to the drawings, and more in particular to FIG. 1, therein is illustrated an ignition system for an internal combustion engine, in accordance with the invention, comprising an ignition coil L having a primary winding L1 and a secondary winding L2. The secondary winding L2 is adapted to be connected to the distributor of the engine in the conventional manner. Thus, as illustrated in FIG. 2, the high voltage lead 10 connected to the common terminal of distributor V is connected to one end of a secondary winding in the ignition coil L, and the other end of the secondary winding may be connected to ground reference by way of the conductor 11. The distributor V is constructed in the conventional manner, with the switched contacts thereof being connected to spark plugs ZK, only one of which is illustrated in FIG. 2.

Referring again to FIG. 1, one end of the primary winding L1 is connected to ground reference by way of the contact-breaker contacts SW1. The other end of the primary winding L1 is connected by way of a capacitor C1 and switch contacts SW3 to the positive terminal of the battery B. The negative terminal of the battery B is grounded. The junction between the capacitor C1 and the switch contact SW3 is connected to ground reference by way of switch contact SW2. In addition, a diode D1 is connected in parallel with the series circuit including the capacitor C1 and switch contact SW3. The diode D1 is poled so that current may flow thereto from the positive terminal of the battery to the primary winding L1 of the ignition coil L. In other words, the anode of the diode D1 is connected to the positive terminal of the battery B.

The contacts SW1, SW2 and SW3 are intercoupled, whereby contacts SW1 and SW3 are open and contacts SW2 are closed at the same time as illustrated by the dashed line interconnections in these contacts, and similarly, when contacts SW1 and SW3 are closed, contacts SW2 are open, as illustrated in solid lines in FIG. 1.

In operation, when the contacts SW1 and SW3 are open, and the contact SW2 is closed, as illustrated by the dashed line in the connections of these switch contacts, the capacitor C1 will be charged by the battery B by way of diode D1 and the switch contact SW2, so that the upper electrode of the capacitor C1 will be positive with respect to the lower electrode in the circuit illustrated in FIG. 1.

When the contacts SW1 and SW3 are closed, and the contact SW2 is open, it is apparent that twice the battery voltage of the battery B will be applied to the primary winding L1 of the ignition coil. For example, if the battery B has a nominal voltage of 12 volts, when the contacts SW1 and SW3 are closed and the contact SW2 is open, a voltage of 24 volts will appear at the primary winding L1. The circuit of FIG. 1 thus doubles the battery voltage applied to the primary winding L1. Upon the next opening of the contact SW1, an increased voltage, for example 30 kV, will be produced in the secondary winding L2 of the ignition coil L.

In the event of breakdown of the switches SW2 and SW3, or other components of the circuit of FIG. 1, it is an advantage that the operation of the internal combustion engine employing this circuit, can be maintained without interruption, since in this case the primary winding L1 may be energized by way of the diode D.

FIG. 2 illustrates in a simplified manner the electrical wiring diagram of an internal combustion engine employing the circuit of the invention as shown in FIG. 1. The components of the circuit of FIG. 1, with the exception of the ignition coil L, the contact SW1 and the battery B, are incorporated within the block S in FIG. 2. As illustrated in FIG. 2, the positive terminal of the battery B is connected by way of a switch, for example, an ignition lock ZS, to the block S by way of lead 12. This lead is connected to one terminal of the switch SW3 and to the anode of the diode D1. The upper electrode of the capacitor C1 and the cathode of the diode D1 are connected by way of lead 13 to the positive end of primary winding L1 of ignition coil L. The lead 14 connects the other end of the primary winding to the block S for purposes that will be described in greater detail with reference to FIG. 3. The negative terminal of the ignition coil L, which may be connected with one end of each of the primary and secondary windings, is connected by way of the contact-breaker contacts SW1 in the distributor V to ground. The distributor V is conventional.

Figure 3:
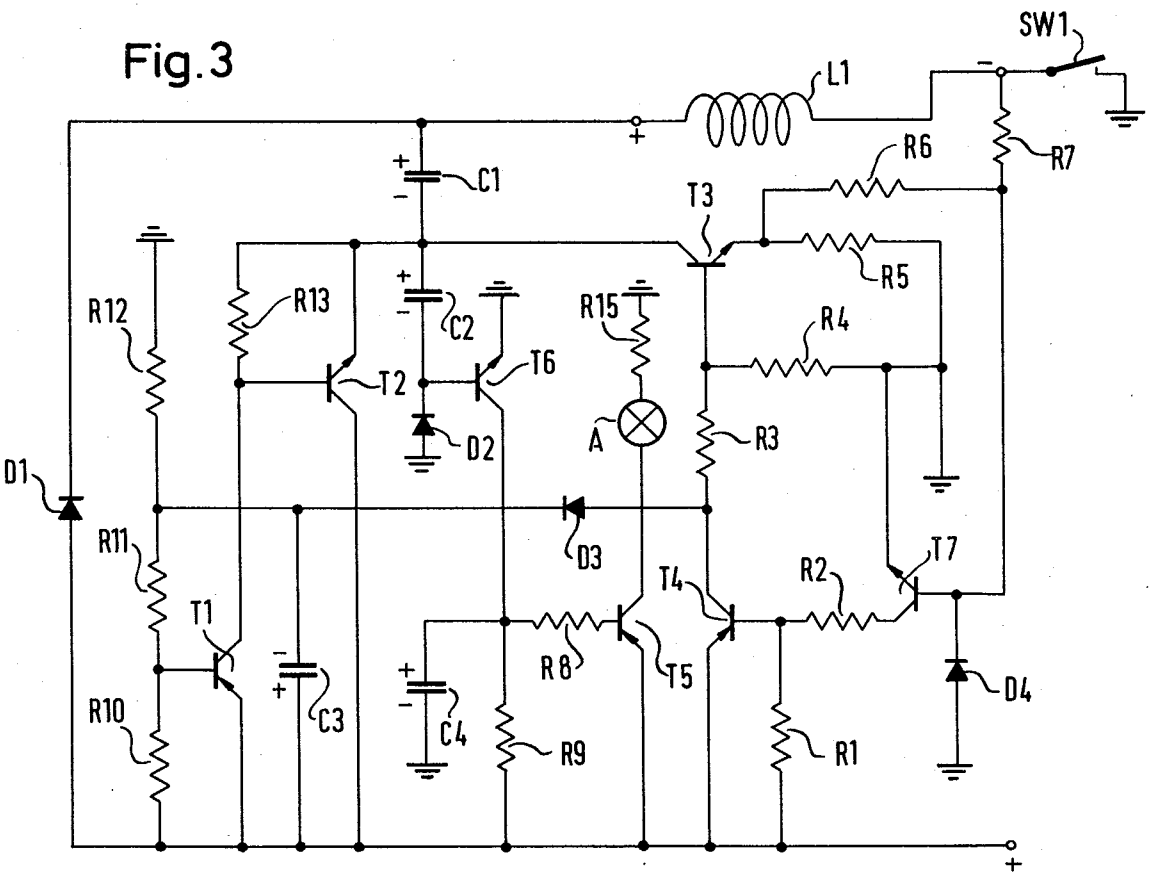
FIG. 3 is a circuit diagram of one embodiment of the device according to the invention using switches in the form of semi-conductor switches.
Figure 4:
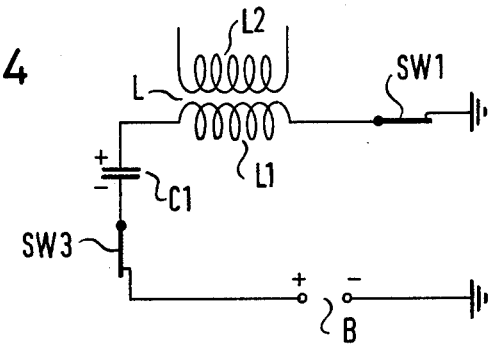
FIGS. 4 to 7 show the individual states of the circuit diagrams explaining the circuit shown in FIGS. 1 and 3.

FIG. 3 shows an embodiment of a device S according to the invention in transistorized form which may be employed in a system in which the battery negative terminal is grounded. The switch SW3 in this embodiment comprises a cascade circuit of two transistors T1 and T2, while switch SW2 comprises the transistors T3, T4, T7. The circuit diagram of FIG. 3 shows an indicator lamp A which is also shown in FIG. 2, and which is connected to indicate that the device S according to the invention is in operation. The switch SW1 comprises the contact-breakers in a distributor, adapted, for example, to be opened and closed by rotation of a cam coupled to rotate in synchronism with the engine drive shaft.

The emitter of the npn transistor T2 is connected to the negative side of the capacitor C1. The collector of transistor T2 is connected to the positive terminal of the battery B. The base of transistor T2 is connected to the collector of the pnp transistor T1, and the emitter of transistor T1 is connected to the positive terminal of the battery B. The base of the transistor T1 is connected via a resistor R10 to the positive terminal of the battery. The base of the transistor T2 is connected to the negative side of capacitor C1 via a resistor R13. The positive side of the capacitor C1 is connected to the positive terminal of the primary winding of the ignition coil L.

The collector of the npn transistor T3 is connected to the emitter of the transistor T2 and the emitter lead of transistor T3 is connected via a resistor R6 and a resistor R7 in series to the negative terminal of the primary winding of the ignition coil L. The negative terminal of the ignition coil L leads to the contact-breaker contact SW1 and is grounded when said contact SW1 is closed as above described. The base of the transistor T3 is connected via a resistor R3 to the collector of a pnp transistor T4, the emitter of transistor T4 being connected to the positive terminal of the battery and the base of transistor T4 also being connected to the positive terminal of the battery via a resistor R1. The base of the transistor T4 is also connected to the collector of an npn transistor T7 via a resistor R2. The emitter of transistor T7 is grounded, the base of transistor T3 is grounded via a resistor R4, and the emitter of transistor T3 is grounded via a resistor R5. The base of the transistor T7 is connected to the connecting point between the resistors R6 and R7 on the one hand and to the cathode of diode D4 on the other hand, the other side of the diode D4 being grounded so that the conductive direction of diode D4 is from ground to the base of transistor T7.

The diode D1 is connected between the positive terminal of battery B and the connecting point between capacitor C1 and the positive side of the primary winding of the ignition coil L.

One terminal of lamp A is grounded via a resistor R15 while the other terminal is connected to the collector of the pnp transistor T5, the emitter of transistor T5 being connected directly to the positive terminal of the battery B. The base of transistor T5 is connected via resistor R8 and resistor R9 in series to the positive terminal of the battery B. The connecting point between the resistors R8 and R9 is connected to the positive side of the capacitor C4, the negative side of capacitor C4 being grounded. The common connecting point between the resistors R8 and R9 is also connected to the collector of an npn transistor T6. The emitter of transistor T6 is grounded and the base of transistor T6 is connected to the negative side of the capacitor C2. The positive side of capacitor C2 is connected to the negative side of capacitor C1. The base of transistor T6 is also connected to the cathode of a diode D2, the other terminal of diode D2 being grounded so as to be conductive from ground toward the base.

The connecting point between resistor R10 and the base of transistor T1 is grounded via a resistor R11 and a resistor R12 in series. The common connecting point between the resistors R11 and R12 is connected via a diode D3 to the collector of transistor T4 and also to the negative electrode of a of a capacitor C3. The positive electrode of capacitor C3 is connected to the positive terminal of the battery B. Diode D3 is so connected that the current can flow from the collector of the transistor T4 to the connecting point of the resistors R11 and R12, i.e., its anode is connected to the collector of transistor T4. On its side remote from the resistor R6, the resistor R7 is connected to the contact-breaker contact and hence also to the negative terminal of the ignition coil L.

Figure 5:
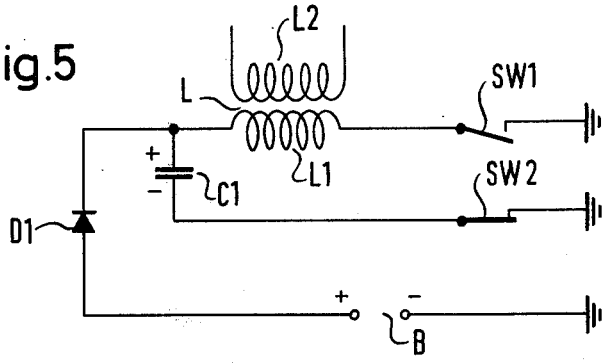
Figure 6:
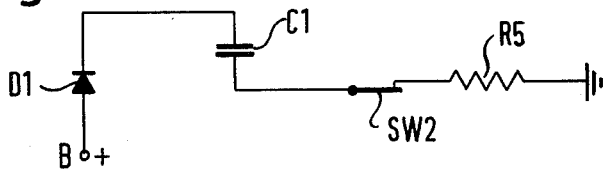
Figure 7:
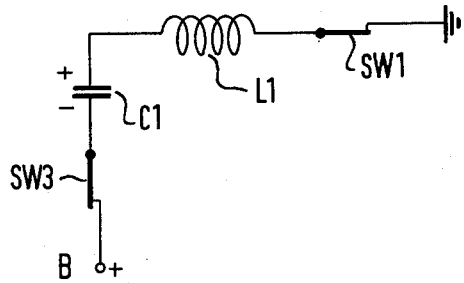

The operation of the circuit illustrated in FIG. 3 will now be described with reference to FIGS. 4 to 7. The description will be based on the state of the circuit shown in FIG. 4, in which the contact-breaker contact SW1 and switch SW3 are closed and switch SW2 is open. In this state, a magnetic field builds up in the primary winding L1 of the ignition coil as a result of the current flowing between the positive terminal of the battery and the capacitor C1 connected in series with the battery. This current flows through the ignition coil and the switch contact SW1. When the contact SW1 is opened, the magnetic field breaks down and a high voltage is induced in the secondary coil L2 because of the large change in dI/dt. The spark thus striking between the spark plug electrodes initiates ignition of the fuel and air mixture. During the combustion process, the switch SW2 is closed and the switch SW3 is open as shown in FIG. 5. The current from battery B then flows via diode D1 and switch SW2, so that the capacitor C1 connected therebetween becomes charged. The capacitor C1 is fully charged before the contact-breaker contact SW1 next opens.

The function of the individual elements of the circuit shown in FIG. 3 is as follows: On opening of the contact-breaker contact SW1, a steady voltage corresponding to the steady current is induced, the value being about 500 V. This voltage acts via the resistor R7 and biases the base of the transistor T7 so that it becomes conductive. Transistor T4 is thus driven via its base and becomes conductive so that in turn the transistor T3 is driven at its base and becomes conductive, whereby switch SW2 which includes transistors T3, T4 and T7 is closed during ignition. The charging current of the capacitor C1 flowing via the transistor T3 and the resistor R5 and by way of R6 produces a decreasing voltage at the base of transistor T7. The three cooperating transistors T7, T4 and T3 thus act as a thyristor or a SCR, which effects complete charging of the capacitor C1. Since transistor T4 is now conductive, the emitter-collector voltage of the transistor T4 is very small, so that the transistors T1 and T2 are shut off. In this condition, the circuit is similar to the circuit diagram given in FIG. 6.

From this Figure it will be seen that in this position of the circuit the capacitor C1 is immediately charged up again during the ignition or combustion process in the cylinder.

As soon as the contact-breaker contact SW1 closes, the SCR formed by the transistors T3, T4 and T7 is re-set, because the capacitor C1 is fully charged up. Transistor T3 is thus cut off and the transistors T7 and T4 are also cut off via a reverse current. Transistor T1 then becomes conductive as a result of the voltage applied to the base of transistor T4 and as a result of the elimination of the short circuit formed via the diode D3. This short circuit extends across the base resistor of T1, so that the base of transistor T2 is driven and the transistor T2 also becomes conductive. At that moment, the circuit corresponds to the simplified circuit diagram shown in FIG. 7.

As a result of the series-circuit formed by the battery and the charged capacitor C1 to the primary coil L1, the magnetic field building up or the steady current increases greatly. On the next opening of the contact-breaker contact SW1, the required high secondary voltage, i.e. high energy ignition spark, is then induced.

Figure 8:
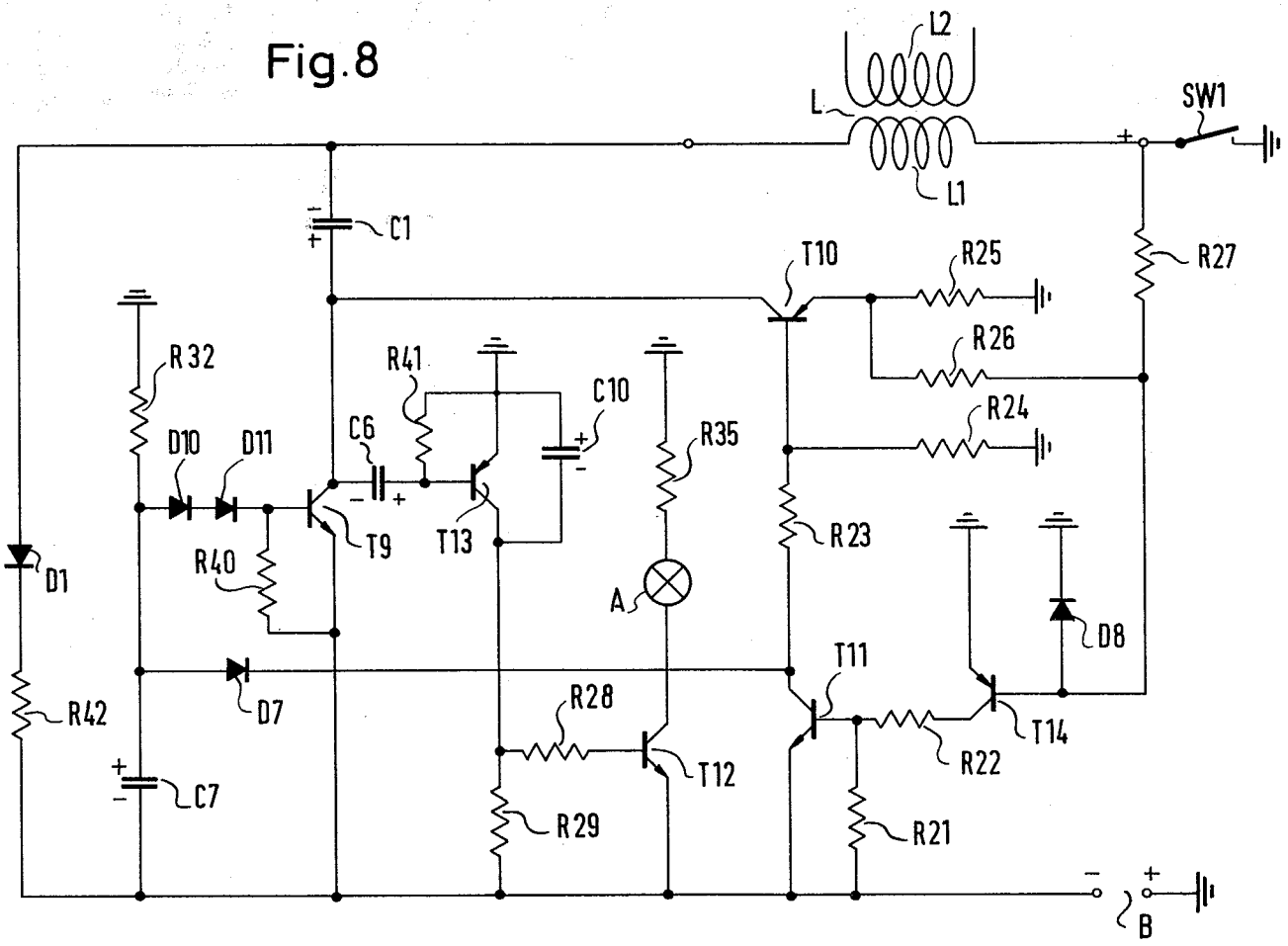
FIG. 8 is a circuit corresponding to the circuit shown in FIG. 3 for use when the positive terminal of the battery is grounded.

FIG. 8 shows an embodiment of the invention which corresponds to the embodiment shown in FIG. 3, but which is intended for systems in which the battery positive terminal is grounded. In this embodiment, the switch SW3 comprises essentially the transistor T9 and the series connected diodes D10 and D11 connected to the base of transistor T9. The emitter of npn transistor T9 is connected to the negative terminal of the battery and the collector of transistor T9 is connected to the positive side of the capacitor C1. The negative side of the capacitor C1 leads to the negative terminal of the corresponding ignition coil L. A capacitor C7 has its negative electrode connected to the negative side of the battery B and its positive electrode grounded via a resistor R32. The common point between the capacitor C7 and the resistor R32 is connected to the anode of diode D10, the cathode of diode D10 being connected to the anode of diode D11, i.e., in the conducting direction with respect to the base of the transistor T9. The base of transistor T9 is also connected to the negative battery terminal via a resistor R40.

The switch SW2 is formed by the pnp transistor T10, the npn transistor T11 and the pnp transistor T14. The collector of the transistor T10 is connected to the collector of the transistor T9, its emitter of transistor T10 is grounded via a resistor R25 and is also connected to the base of the transistor T14 via a resistor R26. The base of T14 is also connected via a resistor R27 to the positive side of the coil, i.e. to the contact-breaker contact SW1. The base of transistor T14 is also grounded via a diode D8 in the conducting direction to ground, i.e. the cathode of diode D8 is grounded. The emitter of T14 is grounded. The collector of transistor T14 is connected via a resistor R22 to the base of the transistor T11. The base of transistor T11 is also connected to the battery negative terminal via a resistor R21. The emitter of transistor T11 is connected to the negative terminal of the battery, and the collector of transistor T11 is connected to the base of transistor T10 by way of a resistor R23. The base of T10 is grounded via a resistor R24. The collector of transistor T11 is also connected via a diode D7 to the positive electrode of the capacitor C7, the conducting direction of D7 being selected toward the collector, i.e., the cathode of diode D7 is connected to the collector of transistor T7.

For security purposes, in the event of breakdown of the device, the negative input of the coil L is connected to the negative terminal of the battery B via the diode D1 and a resistor R42 connected in series therewith. The conductive direction chosen is from the coil to the battery, i.e., the anode of diode D1 is directed toward the coil L1.

The voltage supply to the lamp A comprises a npn transistor T12, the emitter of transistor T12 being connected to the negative battery terminal and the collector of this transistor being connected to one terminal of the lamp A. The other terminal of lamp A is grounded via a resistor R35. The base of transistor T12 is connected to the negative terminal of the battery via a resistor R28 and a resistor R29 connected in series therewith. The common point between the resistors R28 and R29 is connected to the collector of a pnp transistor T13, the emitter of this transistor being grounded. The collector and the base of transistor T13 are grounded via capacitor C10 and a resistor R41 respectively. The base of transistor T13 is also connected to the collector of the transistor T9 via a capacitor C6.

The operation of the circuit shown in FIG. 8 corresponds to the switching operations described above in connection with the first embodiment with reference to FIGS. 1 to 7. The diodes D10 and D11 substantially perform the function of the transistor T4 in FIG. 3. Transistor T9 is cut off when its base and emitter are at the same potential.

According to one exemplified embodiment, the resistors in the circuit shown in FIG. 3 have the following values:

| | | | |
|---|---|---|---|
| R1 | 2.2 k Ω | R2 | 1 k Ω |
| R3 | 270 Ω | R4 | 1 k Ω |
| R5 | 1 Ω | R6 | 3.3 k Ω |
| R7 | 470 k Ω | R8 | 1 k Ω |
| R9 | 5.6 k Ω | R10 | 100 Ω |
| R11 | 470 Ω | R12 | 470 Ω |

-continued

| | | | |
|---|---|---|---|
| R13 | 470 Ω | R15 | 100 Ω |

In an embodiment of a circuit for a 24 V battery, the values are as follows: R2 2 kΩ, R3 470Ω, R10 1.5 kΩ, R11 1.5 kΩ, R12 220Ω. The capacitor C1 may, for example, be 1 000 μF.

In the circuit shown in FIG. 8, the resistors have the following values according to one exemplified embodiment:

| | | | |
|---|---|---|---|
| R21 | 2.4 k Ω | R22 | 1 k Ω |
| R23 | 220 Ω | R24 | 1 k Ω |
| R25 | 1 Ω | R26 | 3.3 k Ω |
| R27 | 470 k Ω | R28 | 1 k Ω |
| R29 | 5.6 k Ω | R32 | 220 Ω |
| R35 | 100 Ω | R40 | 470 Ω |
| R41 | 100 Ω | R42 | 0.2 Ω |

With this circuit according to the invention, even with the battery fully charged, combustion is much better than with the previous systems. Also, when the circuit is used, combustion in engines which have not reached operating temperature was greatly improved, and spark plug life was also increased. More particularly, a more accurate ignition time is obtained at all speeds.

By the variation of the elements of the circuit, it is apparent that the system in accordance with the invention, as shown in FIGS. 3 and 8, may readily be adaptable, and adjustable for operation with ignition systems employing batteries of different sizes, such as the conventional 6 volt, 12 volt and 24 volt systems. As described above, the system is also adaptable for use with positive or negative grounded batteries. In an advantageous embodiment of the invention, the device S as illustrated in FIG. 2, which incorporates the circuit in accordance with the invention, may be installed in a metal case preferably grounded to the chassis of the vehicle in which the device is installed, and including cooling fins F as shown in FIG. 2. The installation of this system requires only minor interconnection changes in a conventional wiring of an automotive vehicle, so that the device in accordance with the invention may be readily and economically employed on any conventional motor vehicle.

Although the invention has been described with reference to specific example embodiments, it will be appreciated that it is intended to cover all modifications and equivalents within the scope of the appended claims.

What is claimed is:

1. In an apparatus for producing an ignition voltage for an internal combustion engine, including an ignition coil having primary and secondary windings, a battery, and a circuit including ignition switching means connecting said battery to said primary winding, said ignition switching means being connected in series with said primary winding in said circuit; the improvement wherein said circuit further comprises a capacitor, means for connecting said capacitor in series with said battery when said ignition switching means are open, for charging said capacitor, and means for connecting said capacitor in series with said battery, primary winding and ignition switching means when said ignition switching means are closed, whereby the sum of the voltage of said battery and the voltage across the capacitor is applied to said primary winding, resulting in increased current flow in said primary winding and thereby increased storage of magnetic energy in said ignition coil for increasing the voltage storage of said ignition coil when said ignition switching means is opened.

2. The apparatus of claim 1, wherein said ignition switching means comprise contact-breaker means connected between one end of said primary winding and one terminal of said battery.

3. The apparatus of claim 1, further comprising a diode connected between one terminal of said battery and said primary winding, whereby said diode is connected in parallel with said capacitor when said ignition switching means are closed.

4. The apparatus of claim 1, wherein said circuit comprises first switch means (SW3) and second switch means (SW2), said first switch means (SW3) and capacitor (C1) being connected in series between one end of said primary winding and one terminal of said battery, whereby the capacitor is connected to said one end of the primary winding and the first switch means is connected to said one battery terminal, said second switch means being connected between the junction of said capacitor and said first switch means and the other terminal of said battery, means opening and closing said first switch means (SW3) when said contact-breaker means are opened and closed respectively, means opening and closing said second switch means (SW2) when said contact-breaker means are closed and opened respectively, and diode means connected between said one terminal of said battery and said one end of said primary winding and poled to normally conduct current from said battery to said primary winding, whereby said diode means are connected in parallel with said series connection of said capacitor and of said first switch means.

5. The apparatus of claim 4, wherein said first and second switch means are semi-conductor switches and said diode comprises a semi-conductor diode.

6. The apparatus of claim 1, further comprising indicator lamp means connected to indicate an operative condition of said connecting means.

7. The apparatus of claim 1, forming a circuit arrangement connected to the two ends of said primary winding and to the two terminals of said battery.

8. The apparatus of claim 1, wherein said connecting means comprises a grounded casing having cooling fins, and circuit means within said casing.

9. An apparatus for applying a high voltage to a fuel ignition device, especially for an internal combustion engine, comprising an ignition coil having a high voltage secondary winding adapted to be connected to the fuel ignition device, and a primary winding, ignition switching means synchronized with the internal combustion engine, a battery, said ignition switching means (SW1) being connected between one terminal of the battery and one end of the primary winding and means for interconnecting the other end of the battery with said primary winding, said interconnecting means comprising a capacitor and first switch means (SW3) connected in series in that order between the other end of said primary winding and the other terminal of said battery, second switch means (SW2) connected between the first mentioned terminal of said battery and the junction between said capacitor and first switch means (SW3), and diode means (D1) connected between the other terminal of said battery and the other end of said primary winding, said diode means being poled to conduct current from said battery through said primary winding, and further comprising means for opening and closing said first switch means (SW3) in response to the opened and closed state respectively of said ignition switch means (SW1), and means for opening and closing said second switch means (SW2) in response to the closed and opened states respectively of said ignition switch means.

10. The apparatus of claim 9, wherein said first and second switch means comprise semi-conductor switches.

11. The apparatus of claim 9, wherein said ignition switch means (SW1) are contact-breaker means.

* * * * *